United States Patent [19]

Nussbaum

[11] 4,173,268

[45] Nov. 6, 1979

[54] HOIST MECHANISM

[76] Inventor: Hans Nussbaum, Korker Strasse 6, 7641 Bodersweier, Fed. Rep. of Germany

[21] Appl. No.: 846,165

[22] Filed: Oct. 27, 1977

[30] Foreign Application Priority Data

Oct. 29, 1976 [DE] Fed. Rep. of Germany ..... 2649769
Sep. 23, 1977 [DE] Fed. Rep. of Germany ..... 2742961

[51] Int. Cl.[2] ..... B66F 7/00
[52] U.S. Cl. ..... 187/8.49; 254/92
[58] Field of Search ..... 187/8.41, 8.47, 8.49, 187/8.5, 8.59, 8.69; 254/89 R, 92

[56] References Cited

U.S. PATENT DOCUMENTS

| | | | |
|---|---|---|---|
| 2,564,267 | 8/1951 | Manke | 254/89 R |
| 2,843,223 | 7/1958 | Villars | 187/8.47 |
| 3,435,915 | 4/1969 | Villars | 187/8.47 |
| 3,687,234 | 8/1972 | Gendreau | 187/8.59 |
| 3,958,664 | 5/1976 | Perkins | 187/8.47 |
| 4,022,428 | 5/1977 | Mantha | 187/8.47 |

FOREIGN PATENT DOCUMENTS

| | | | |
|---|---|---|---|
| 2064243 | 1/1973 | Fed. Rep. of Germany | 187/8.47 |

*Primary Examiner*—Jeffrey V. Nase
*Attorney, Agent, or Firm*—Wegner, Stellman, McCord, Wiles & Wood

[57] ABSTRACT

A plural column hoist mechanism in which the lifting slides are synchronized by a chain and safety devices are operative in the event of chain breakage. If the chain is slack, the hoist mechanism may be operated to effect upward travel of the lifting slides.

11 Claims, 5 Drawing Figures

2
17
18
19
5
16
4
1
21
3
15
9
8
7
31
37
36
20
32
33
34
35
13
12
11
10
30
29
14
13
9
24
26
6
27
28
24
22
38
39
40
9
42
25
31
41
23
9
24
26

HOIST MECHANISM

The invention relates to a hoist mechanism with at least two lift columns, each having a movable lifting slide associated therewith with the lift columns being synchronized with each other by means of a chain and, more particularly, to such a hoist mechanism having a spring-loaded safety element for activating a switching element.

In German DT-OS No. 2,064,243, a hoist mechanism is shown having two lift columns, each of which includes a lifting slide driven by an elevating nut. Threaded spindles associated with both lift columns, one of which is connected to a motor, are driven synchronously by means of a chain. The chain runs over a sprocket at the lower end of each threaded spindle and over glide rollers which are situated between the two lift columns under cover. This constuction with two-spindle nut systems is very costly in production and maintenance.

The purpose of the invention is to design a lifting platform of the aforementioned type in such a way that it is simpler and cheaper both to manufacture and to maintain.

The problem is solved, according to the invention, by attaching the chain to the lifting slides of both lift columns. By means of this arrangement, a very simple chain system is achieved, since only one chain strand is necessary between the two lifting slides. With one lift column equipped with the drive motor, the second lift column can be made extremely simple, since the lifting slide merely needs to be guided and requires no driving mechanism.

The spring-loaded element for the activation of a switch or switching element in case of chain breakage can be provided at any desired place on the chain's path; preferably, however, the spring-loaded element is attached to one of the lifting slides. This provides an advantageous connection with the switching device of the lifting platform. Since the end of the chain follows along with the lifting slide, a simple spring-loaded element can be provided that lies against the chain, without the latter sliding or rolling over this element.

The spring-loaded element can be a spring-loaded roller or sliding contact even though there may be no relative motion between the chain and this element. Preferably, however, according to one embodiment of the invention, the end of the chain is fastened to the lifting slide by means of a compression spring. It is advisable in this case for the end of the chain to be led through an anchorage on the lifting slide and provided with a spring washer which serves as a thrust support for the compression spring which is braced against the anchorage.

According to one embodiment of the invention, a Bowden cable is provided between the spring washer and the support, whose other end is fastened to a switch or a switching element. In this case, the Bowden cable can lead directly to a switching device located, for example, on the motor.

It is desirable that the chain end to be capable of directly activating a mechanical or electrical switch or switching element located in the vicinity of the spring washer or the chain suspension. According to a preferred embodiment of the invention, the chain is spring-suspended on the driven lift column in the rear lower part of the lifting slide. The spring suspension interacts with a spring-loaded contact spud which is located on the lifting slide and embraces a switch rod against which the contact can be clamped by tilting. Because of the suspension of the chain in the rear part of the lifting slide, the guide roller can be located inside the lift columm. At the same time, in connection with the lifting motion there is a move favorable moment on the lifting slide or on its supporting roller in the driven lift column.

The chain which is attached to one lifting slide yielding opposite to the direction of pull is fastened immovable to the second lift column. The lifting slide of this second lift column is advantageously carried on a grip rod and provided with a gripping safety device, by means of which the lifting slide can be clamped against the grip rod. This grip rod may be in the form of a toothed rack with which a notch on the lift slide can mesh. According to one simple version, a tilting element, which embraces the grip rod and is clamped against the latter by tilting, is provided as a gripping safety device.

In the event of a chain breakage or slackening, this gripping safety device can be activated electrically or mechanically, by the flexible suspension of the chain on the other elevating column. The activation of the gripping safety device is provided by a spring-loaded chain feeler which is connected with the gripping safety device and fastened to the lifting slide.

Figure 1:
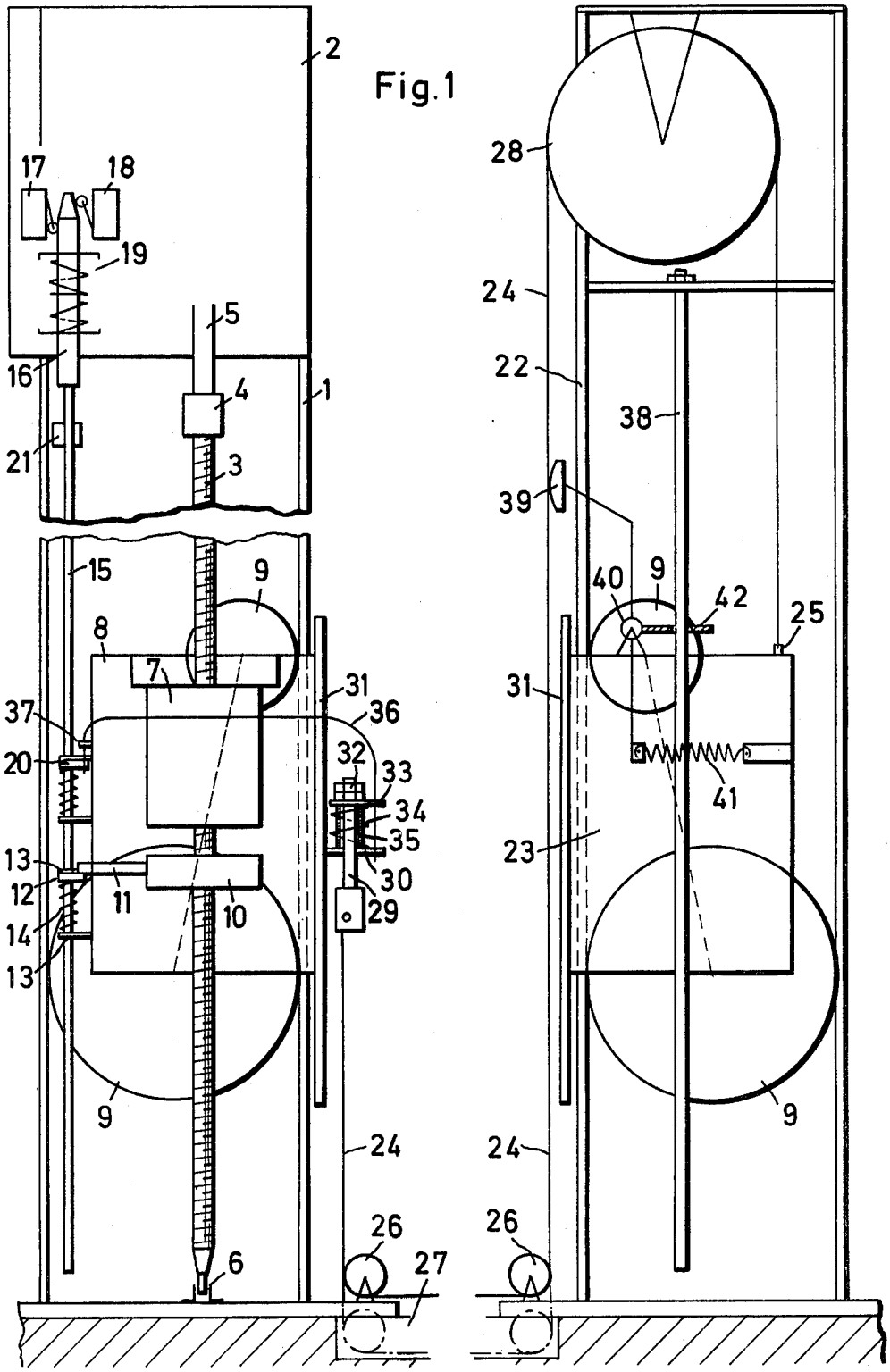
FIG. 1 shows a schematic view of a two-column hoist mechanism.

In FIG. 1, a lift column 1 has a motor 2 located at the upper end which drives an elevating screw 3. The elevating screw 3 is connected to the motor shaft 5 by means of a friction clutch 4. The lower end of the elevating screw 3 is supported by a bearing 6. A lifting slide 8 which schematically shown, rests on a lifting nut 7 and is guided in the lift column 1 by rollers 9.

Positioned a short distance under the lifting nut 7 is a following nut 10 threaded on the elevating screw 3. The following nut 10 has a radially projecting trip 11 which lies against a contact spud 12. The contact spud 12 is located between two support plates 13 attached to the lifting slide 8 and is held against the upper support plate by a compression spring 14. Running through the support plates 13 and the contact spud 12 is a switch rod 15 which is movably suspended at the upper end of the lift column 1 and leads to the switching element adjacent the motor 2.

The switch rod 15 has at its upper end a switch plunger 16, whose tapered end is located between two limit switches 17 and 18. The switch rod 15 has a movable suspension 19. Abutting both sides of an annular shoulder of the switch plunger 16 is a compression spring which is braced against a thrust support attached to the lift column 1 through which the switch rod 15 or the switch plunger passes. The two counteracting compression springs hold the switch rod 15 in a neutral position, as shown in FIG. 1. The switch rod 15 is thus movable upward against the upper compression spring and downward against the lower compression spring. When the switch rod 15 is moved upward, the limit switch 18 is actuated; when it is moved downward, the limit switch 17 is actuated. In each case, the motor is shut off.

The switch rod 15 is pushed downward by the contact spud 12 when the contact spud 12 is tilted by the trip pin 11 and thus clamped on the switch rod 15. This switching action takes place when the lifting slide 8 comes to rest at the lower limit position and the following nut 10 is caused to move still lower by the turning of the elevating screw 3. Because of relative motion between the following nut 10 and the lifting slide 8 or the contact spud 12 attached to it, the contact spud 12 is tilted and thus clamped fast on the switch rod 15, so that the switch rod 15 is pushed downward by the contact spud 12 to shut off the motor 2. Further, should the elevating nut 7 break so that the load is put on the following nut 10, the switch rod 15 will shut off the motor 2.

On the lifting slide 8 above the contact spud 12, another contact spud 20 is provided, which interacts with a stop 21 is fixed to the upper end of the lifting column 1 and determines the upper limit position of the lifting slide 8. Further, the contact spud 20 serves to switch off the motor 2 in the event of an interruption of the connection with the second lifting column or a breakdown of the second lifting column as will be explained in more detail below.

In the second lift column 22, a lifting slide 23 is also guided by rollers 9, similar to the lift slide 8 of the first lift column 1. The lift slide 23 is provided with supporting arms 47 (FIG. 4), which for the sake of simplicity not shown in FIG. 1, for supporting a load. Lifting motion of the lifting slide 23 is accomplished by a chain 24 connected with the lifting slide 8 of the first lift column 1. The chain 24 is attached to the lifting slide 8 of the first lift column 1 yieldingly so that it is movable in the direction opposite to the direction of pull, as is more fully explained hereinafter, and is attached immovable to the lifting slide 23 of the second lift columm 22 at 25. The chain 24 is guided at the lower end of the two lift columns over guide rollers 26 which can be attached above the floor to the lift columns or — as shown by the dotted lines in FIG. 1 — located in a recess 27 formed in the floor between the two lift columns, so that no threshold-like covering is required between the two lift columns. On the second lift column 22, the chain 24 is led around a guide roller 28 which rotates at the upper end of the lift column 22.

If the lifting slide 8 on the first lift column 1 is moved upward by the lifting nut 7 and by turning the elevating screw 3, the lifting slide 23 on the lift column 22 is simultaneously pulled upward by the chain 24. With downward motion of the lifting slide 8, the lifting slide 23 moves downward under its own weight with the chain 24 remaining taut between the two lifting slides.

In the event that the chain 24 breaks or in the event that there is an obstacle under the support arms of the lifting slide 23 which causes a slackening of the chain when the lifting slide 23 drops, a safety device on the lifting device 8 of the drive motor- and switching device-equipped lift column 1 is operative and includes suspension of the chain 24 which yields in the direction opposite to the direction of pull. In the vicinity of lifting slide 8, the chain end is attached to a bolt 29 which extends through and is movable within a hole in a plate 30 attached to the lifting slide 8. The plate 30 provides an anchorage for the chain end. In the embodiment shown in FIG. 1, the plate 30 is attached at substantially right angles to a plate-like component 31 which extends in the longitudinal direction of the lift column 1 and forms the external part of the lifting slide 8 which is adapted to received support arms. The bolt 29 has a threaded upper end with a nut and a locknut 32 threaded thereon. Against these nuts 32 is a spring washer 33 that serves as a thust support for a compression spring 34 which abuts on the plate 30. Between the spring washer 33 and the plate 30 is a casing 35 surrounding the bolt 29, by means of which the chain 24 is braced against the lifting slide 8 in the direction of pull. Between the spring washer 33 and the anchor plate 30 a Bowden wire 36 is attached which leads to the contact spud 20 on the rear side of the lifting slide 8. The cable of the Bowden wire 36 is attached on the one end to the anchor plate 30 and on the other to the contact spud 20. The casing of the Bowden wire is supported on the one end on the spring washer 33 and on the other by an ear 37 attached to the lifting slide 8.

During normal operations of the hoist mechanism, the chain 24, due to the inherent weight of the lifting slide 23 on the second lift column 22 or to weight borne by this lifting slide 23, remains taut, so that on the lifting slide 8 of the first lift column the chain end rests, through casing 35, and against the initial stress of the spring 34, against the anchor plate 30. If the chain 24 breaks at any location, then the spring washer 33 is lifted off the casing 35 or moved away from the anchor plate 30 by the initial stress of the compression spring 34, whereby the Bowden wire 36 brings the contact spud 20 into a tilting position in which the switch rod 15 is firmly clamped and is moved a little further up or down with the lifting slide 8, so that the motor is shut off by means of the limit switch 17 or 18. If there is an obstacle on the second lift column 22 underneath the supporting arms or the lifting slide 23 during the descending movement, the chain 24 is slackened, so that the spring washer 33 likewise lifts off the casing and the contact spud 20 is activated via the Bowden wire 36 to shut off the motor.

For the case of a chain breakage or slackening, a safety device is provided on the lifting slide 23 of the second lift column 22 which is an emergency effects such a connection between the lifting slides and the lift columm that the lifting slide is immobilized. In the example of execution shown in FIG. 1, the lifting slide 23 is carried on a grip rod 38 which is suspended in the lift column 22. The gripping safety device with this grip rod 38 thus corresponds in principle to the switching rod 15 and the contact spuds 12 and 20 on the first lift column 1, with the difference that the grip rod 38 in the lift column 22 is stationary.

The gripping safety device has a chain feeler 39 which is attached flexibly to the lifting slide 23 at 40 and held against the chain 24 by a spring 41. With the chain feeler 39, at the pivotal point 40, a gripping piece 42 is attached which, e.g., can be in the form of a ring. During the normal operation, this gripping part 42 slides on the grip rod 38. In the event of a breakage or slackening of the chain, the chain feeder, and therewith the catch 42 is tilted by the spring 41, so that the catch 42 clamps onto the grip rod 38. In the case of a breakage or slackening of the chain, only downward forces are exerted on the lifting slide, so that the grip rod 38 in lift column 22 only needs to be suspended.

Instead of the described clamping safety device, this can also be designed in a different way. Thus, it is possible, for example, to provide a toothed rack as grip rod with which a spring-loaded notched part would mesh in the event of a break or slackening of the chain. Also, on the inside of the lift column 22, e.g., a serrated strip can be installed with which a notched part attached to the lifting slide 23 meshes, so that a grip rode can be dispensed with.

As opposed to the described mechanical solution of the gripping safety device, this can also be constructed so that it is activated by an electrical signal, e.g., by a switching device of the main column or an electrical switch on its chain protection device. Also, the safety device can even be constructed in such a way that the gripping element or elements are maintained in the free position as long as there is a current connection.

Figure 2:
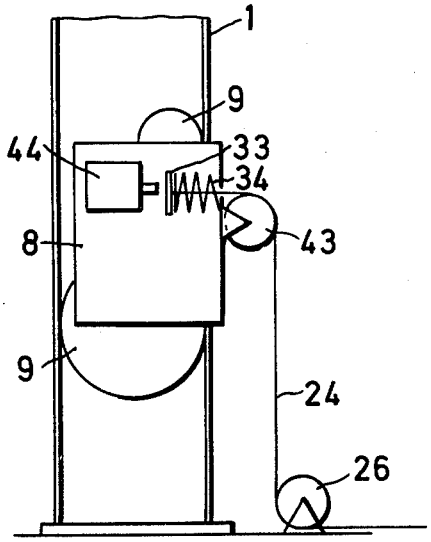
FIG. 2 shows schematically another form of invention of the chain suspension on the lifting slide of the first lift column.

FIG. 2 shows schematically another version of the chain protection on the main column. The spring suspension yielding opposite the direction of motion is in this example of execution installed inside the lifting slide 8. By way of a guide roller 43 which is attached to the lifting slide 8, the chain 24 is led downward to the guide roller 26. In the vicinity of the spring washer 33 a switch 44 is located which in the event of a chain break or slackening is activated by the tension release of the compression spring 34 and the spring washer 33. This switch 44 can feed a signal to the motor 2 and, if desired, also to the safety device on the second lift column. It is more desirable, however, for this switch 44 to be the mechanical type, so that there are no electrical devices in the work area.

Corresponding to the version according to FIG. 2, different variations of the chain suspension yielding contrary to the direction of pull on the main column are possible. Thus, for example, the chain 24 can also be attached directly to the lifting slide 8 and the guide roller 43 loaded by a spring, so that in the event of a chain break or slackening a switching element is activated by this roller 43, which then acts as a chain feeler.

Figure 3:
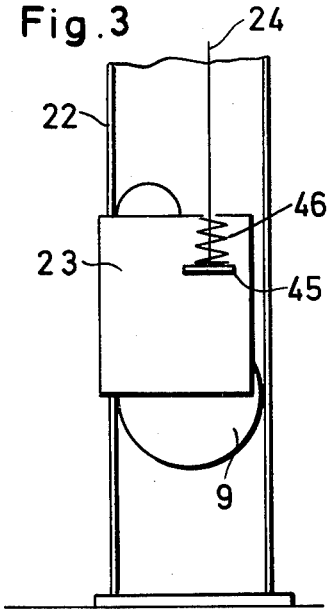
FIG. 3 shows another type of chain suspension on the lifting slide of the second lift column.

Also, the safety device on the second column can be made similar to the chain protection on the main column, FIG. 3 shows schematically a chain suspension yielding contrary to the direction of motion installed on the lifting slide 23, in which the chain end is attached by way of a spring washer 45 and a compression spring 46 to the lifting slide 23 or to an anchorage fastened to it. The spring washer 45 can here serve to activate the safety device through the provision, e.g., of a Bowden wire, as in the case of the chain protector on the main column, or by having the spring washer 45 directly activate the safety device, which, as explained above, can be, e.g., a spring-loaded notched part which presses the lifting slide against the lifting column 22. By means of such a chain suspension yielding opposite to the direction of pull on the second column, a chain feeler 39, which involves friction between itself and the chain 24, can be dispensed with.

According to another embodiment of the invention, the guide roller 28 can be spring mounted on the lift column 22, so that in the event of a chain break or slackening this guide roller 28 shifts to activate the safety device on the lifting slide 23. Correspondingly, the chain protector can be located anywhere along the chain 24 for both the main column and the second columm, e.g., at the guide rollers 26; preferably, however, the chain protector or feeler is provided directly on either lifting slide 8 or 23, since this way the connecting distance to the safety device is shorter and thus more reliable.

The invention is also applicable for a hoist mechanism in which the lifting slide of the main column is driven hydraulically. In the event of the failure of the hydraulic pressure, a clamping safety device similar to that on the second lift column can likewise be provided on the main column.

Figure 4:
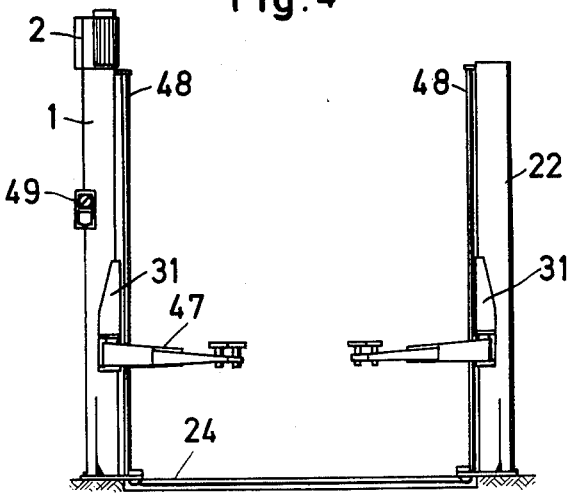
FIG. 4 shows a side view of the hoist mechanism.

FIG. 4 shows a side view of a hoist mechanism wherein the supporting arms attached to the component 31 are represented. As this FIG. 4 shows, both lift columns 1 and 22 are provided on the inside with a frame 48 which serves as an anchoring of a covering, e.g., a rubber strip. This covering covers only the chain protector on the main column and, on the second column, the chain which runs the whole height of the columm, so that both columns are in effect closed. The component 31 for the support arms, which is under cover, embraces the lift column in a U-shape, as FIG. 4 shows, with the supporting arms 47 hinged on the sides. In FIG. 4, 49 shows a switch for starting and stopping the lift platform which is located within reach but high enough to be proctected against spray and dirt.

Instead if the chain 24, a suitably flexible cable could also be provided. Preferably, however, a chain is provided, since this permits a smaller radius on the guide rollers 26 and, in the event of a slackening, e.g., with respect to the feeler 39, yields more easily.

Figure 5:
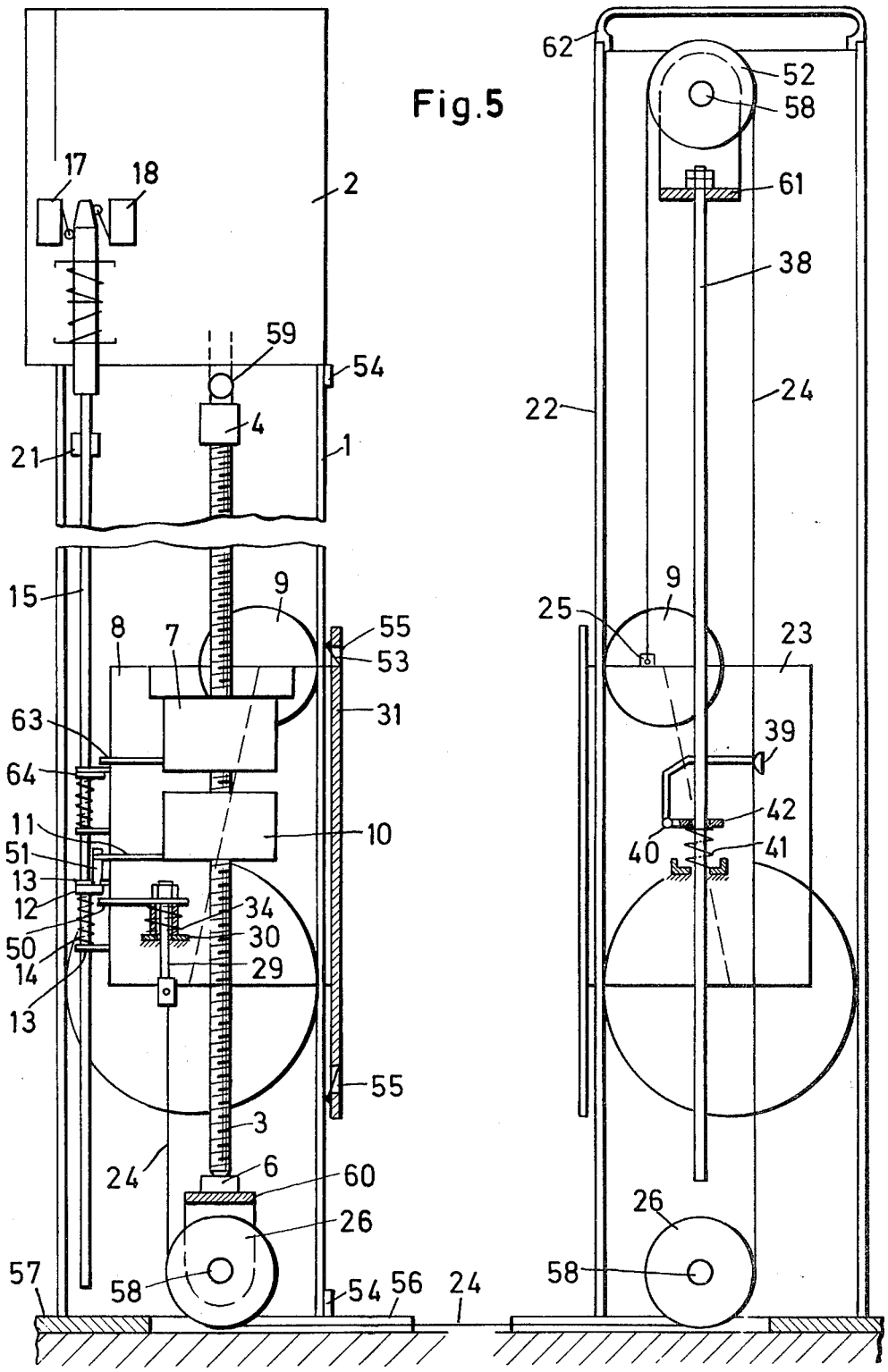
FIG. 5 shows a schematic view of a preferred form of embodiment of the hoist mechanism.

FIG. 5 shows a preferred form of invention, wherein for the same or corresponding components the same reference numbers are used as in FIG. 1. The chain 24 is suspended flexibly at the lower rear part of the lifting slide 8 and directly activates, by way of a trip pin 50 loaded by the spring 34 which corresponds to the spring washer 33 in FIG. 1, the contact spud 12 on the switch rod 15. The contact spud 12 is provided with a bracket 51 with which the trip pin 11 on the following nut 10 interacts. The contact spud 12 can thus be tilted by the chain suspension and also by the following nut 10.

The arrangement of the chain suspension according to FIG. 5 makes it possible to install the guide roller 26 inside the first lift column 1, whereby, in comparison with the hoist of FIG. 1, a more compact structure results. In a like manner, the guide roller 26 on the second lift column 22 is installed within it, with the chain 24 being led through a corresponding opening in the lifting slide 23 and running over a rather small guide roller 52 at the upper end of the second lift column. This form eliminates the structure required for the carrying of the cover strip 48 of FIG. 4 on the front side of the lift columm. The cover strip 53 (FIG. 5) is attached at 54 to the upper and lower end of the lift column and led through slits 55 in the plate-like component 31 of the lifting slide 8. The guide rollers 26 are so arranged that the chain 24 runs in a recess 56 in the base plate 57 of each lift column.

The guide rollers 26 and 52 can be identical. Each is supported pivotally on a bearing bolt 58 which is fastened in a corresponding transverse borehole in the two lift columns. An identical borehole 59 is made at the upper end of the driven lift column 1. It serves for mounting the motor and corresponds to the hole for the bearing bolt of the upper guide roller 52. The two lift columns 1 and 22 can thus, in the form of FIG. 5, be made identical in their external structure.

The guide roller 26 on the first lift column 1 is surrounded by a bracket 60 which carries the bearing 6 for the lifting screw 3 and is supported and swivels on the bearing bolt 58 of this guide roller. Because of the swivelling arrangement of the bearing 6, the elevating screw can be easily installed and removed. A corresponding U-shaped bracket 61 is suspended to swivel on the bearing bolt 58 of the upper guide roller 52 of the second lift column. It supports the grip rod 38. Because of the small diameter of the guide roller 52, a greater lifting height is possible in comparison with the form of execution according to FIG. 1. At 62 a covering for the second lift column is provided.

In the embodiment of FIG. 5, the lift nut 7 is also provided with a trip pin 63 which interacts with a contact spud 64 and tilts the latter if, for example, the lifting slide 8 strikes an obstacle on the way down and at at the same time the lifting nut 7, on which the lifting slide 8 merely rests, is dropped further. Correspondingly, the trip pin 63 serves to shut off at the lower limit position of the lifting slide, while the contact spud 64 interacts with the stop 21 for shutting off at the upper limit position. In the case of breakage or stripping of the lifting nut 7, the following nut 10 takes up the load, whereupon a relative displacement takes place between it and the lifting slide, with the contact spud 12 being tilted by the trip pin 11 on the switch rod 15. By means of the instantaneous connection between lifting slide 8 and switch rod 15, the latter is picked up and the motor shut off.

The switching device is so designed that in the case of chain breakage neither upward nor downward motion is possible, while in the case of chain slackening, e.g., from an object being underneath the support arms attached to the lifting slide, only upward motion is possible, for the removal of the obstruction. Since for the safety switching and for nut breakage the same safety switches 17, 18 are used as for the upper and lower limit switching, a more reliable functioning is always assured, for these switches are continually being checked for their operation in the daily use of the lifting platform. The gripping safety device on the second lift column is designed in FIG. 5 in the same way as in the execution form of FIG. 1.

The embodiment of FIG. 5 makes possible a very compact and simple construction of the hoist mechanism, wherein, with a minimum use of components, maximum safety and performance characteristics are achieved. In the assembly of the hoist, chain halves are provided which are hung on the two lifting slides and then connected with a connecting element between the two lift columns.

According to the invention, a chain protector in the form of a spring-mounted flexible chain suspension or a spring-loaded chain feeler is provided on each lifting slide 8 and 23, even though only one such protective device is required for establishing a signal or initiating an activation action. According to the simplest form of the invention, a gripping safety device is provided on the lifting slide of the second lift column and at a suitable spot along the chain, simply a chain protector which a spring-loaded element, from which electric wires lead to the switching device on the motor and to the gripping safety device. At the same time, the gripping safety device in the second lift column serves not only to immobilize the lifting slide in case of chain breakage, it also provides a connection between grip rod and lifting slide in the event of chain slackening.

Preferably, the invention is used in connection with a spindle nut system on the main column. The principle of the patent is also applicable with several lift columns, with, preferably, a chain protector provided on each individual lifting slide. From the driven main column, a chain or a cable leads to each additional column, or lift slides are provided in series.

I claim:

1. In a hoist mechanism having at least two lift columns with a movable lifting slide in each column and drive means for moving one lifting slide up and down the associated lift column, the improvement comprising:

a synchronizing chain connected between said one lifting slide and the other lifting slide in the other lift column for moving such other lifting slide in synchronism with the one lifting slide;

a spring loaded chain support on said one lifting slide, engaging said chain and movable with respect to said one slide on slackening of the chain; and safety means responsive to such movement of said chain support for stopping said drive means.

2. The hoist mechanism of claim 1 in which the safety means includes a switch actuated upon slackening of the chain and connected with said drive means.

3. The hoist mechanism of claim 2 in which the switch is on said one lifting slide.

4. The hoist mechanism of claim 2 in which the chain support spring is a compression spring located between said one lifting slide and said chain so as to yield opposite to the direction of motion.

5. The hoist mechanism of claim 4 in which the end of the chain is led through an anchorage on said one lifting slide and said compression spring and provided with a spring washer which serves as thrust support for the compression spring which is braced against the anchorage, with a casing installed between the anchorage and the spring washer, which casing serves as a stop for the chain end on the anchorage.

6. The hoist mechanism of claim 2 in which a Bowden wire is connected between the chain support and the switch.

7. The hoist mechanism of claim 2, in which a switch rod is suspended adjacent said one lifting slide so as to move up and down for the activation of said switch and said one lifting slide has contact spuds that are tiltable against spring tension and which embrace the switch rod and interact with trip pins of said drive means as well as with said chain support with the switch provided for limit switching and for shutting off the drive means in the event of drive means breakage or chain slackening.

8. The hoist mechanism of claim 1 in which said other lifting slide is suspended on the chain which is led over an upper and a lower guide roller, and having a gripping safety device which in the case of chain slackening secures said other lifting slide against the said other lift column.

9. The hoist mechanism of claim 8, in which said other lifting slide is associated with a grip rod and a spring-loaded tilting element activated by a chain feeler embraces the grip rod for engagement therewith on slackening of said chain.

10. The hoist mechanism of claim 1, in which the two lift columns are identical in their exterior structure and at the upper and lower end have transverse bore holes which serve for the support of a guide roller and the drive means, with a first U-shaped bracket being pivotally supported on a bearing bolt of a lower guide roller of the one lift column, said bracket having a bearing for a screw spindle forming a part of the drive means, and with a second U-shaped bracket pivotally supported on a bearing bolt of an upper guide roller of the other lift columm, and a grip rod carried by said second U-shaped bracket, with means on said other lifting slide and responsive to slackening of said chain for engaging said grip rod to support said other lifting slide.

11. A hoist mechanism, comprising:

first and second lift columns identical in their exterior structure;

first and second lifting slides movable vertically in the first and second lift columns, respectively;

drive means for moving the first lifting slide in the first lift column;

a synchronizing chain connected at one end to the first lifting slide and at the other end to the second lifting slide to move the second lifting slide in synchronism with movement of the first lifting slide;

a spring loaded chain support on said first lifting slide, engaging said chain and movable with respect to said first lifting slide on slackening of said chain;

safety means responsive to such movement of said chain support for stopping said drive means; and a gripping safety device in said second lift column actuated by slackening of said synchronizing chain to secure said second lifting slide against movement.

* * * * *